US006123531A

United States Patent [19]

Blume et al.

[11] Patent Number: 6,123,531

[45] Date of Patent: Sep. 26, 2000

[54] BEARING ARRANGEMENT FOR A PUMP SHAFT OF A PUMP FOR DELIVERING MEDIA OF DIFFERENT VISCOSITIES

[75] Inventors: Peter Blume, Zürich; Roger Stehr, Bülach, both of Switzerland

[73] Assignee: Maag Pump Systems Textron AG, Zurich, Switzerland

[21] Appl. No.: 08/952,649

[22] PCT Filed: Apr. 29, 1996

[86] PCT No.: PCT/CH96/00164

§ 371 Date: Mar. 4, 1998

§ 102(e) Date: Mar. 4, 1998

[87] PCT Pub. No.: WO96/37705

PCT Pub. Date: Nov. 28, 1996

[30] Foreign Application Priority Data

May 24, 1995 [EP] European Pat. Off. ..... 95107891

[51] Int. Cl.[7] ..... F04C 2/18

[52] U.S. Cl. ..... 418/102; 418/83; 418/132; 418/206

[58] Field of Search ..... 418/102, 206.4, 418/206.7, 206.8, 1, 205, 83, 88

[56] References Cited

U.S. PATENT DOCUMENTS

| | | | |
|---|---|---|---|
| 4,090,820 | 5/1978 | Teruyama | 418/1 |
| 4,160,630 | 7/1979 | Wynn | 418/102 |
| 4,392,798 | 7/1983 | Bowden | 418/102 |
| 4,486,160 | 12/1984 | Lipscombe | 418/205 |
| 4,725,211 | 2/1988 | Gray | 418/102 |
| 4,737,087 | 4/1988 | Hertell | 418/1 |
| 5,324,183 | 6/1994 | Capelle | 418/88 |
| 5,494,425 | 2/1996 | Stehr | 418/83 |
| 5,641,281 | 6/1997 | Russell et al. | 418/102 |
| 5,924,854 | 7/1999 | Blume et al. | 418/83 |

*Primary Examiner*—Teresa Walberg
*Assistant Examiner*—Leonid Fastovsky
*Attorney, Agent, or Firm*—Evenson, McKeown, Edwards & Lenahan, P.L.L.C.

[57] ABSTRACT

A gear pump has a housing, a pump shaft supported in a housing wall by a bearing, and a pumping gear supported on the pump shaft which is operable to pump newtonian and non-newtonian liquid of different densities. A relief collection zone is arranged on a low-pressure side of the bearing for collecting leakage liquid passing through the bearing along the shaft. At least two return ducts or bores are provided which connect the collection or relief zone with a suction side of the pump in order to return the collected leakage liquid.

18 Claims, 2 Drawing Sheets

BEARING ARRANGEMENT FOR A PUMP SHAFT OF A PUMP FOR DELIVERING MEDIA OF DIFFERENT VISCOSITIES

BACKGROUND AND SUMMARY OF THE INVENTION

This application claims the priority of patent application Ser. No. 951 07 891.4 filed in the European Patent Office on May 24, 1995, the disclosure of which is expressly incorporated by reference herein.

The present invention relates to a bearing arrangement for a pump shaft for delivering newtonian or non-newtonian liquids of different viscosities, having a bearing for the shaft, a gear pump, and to a process for collecting and returning leakage liquid passing through a bearing during the pumping of liquids of different viscosities.

In the case of pumps, such as gear pumps, it cannot be prevented or it is not necessary to prevent that a small portion of the liquid medium to be delivered, which is relatively highly pressurized, is driven through a slide bearing, for example, along the drive shaft. As a rule, this leakage flow is used for lubricating the slide bearing. After passing through the slide bearing, the leakage liquid is collected in a collection groove or in a relief groove in order to be returned by way of the connection duct of the pump to its inlet side. Such sealing and returning arrangements are known, for example, from German Patent Documents DE-544 963 and 31 35 037. As long as liquids with largely constant viscosities are continuously delivered in a pump, the known return arrangements are perfectly sufficient. In contrast, during the discontinuous pumping of liquids having very different viscosities, the described arrangements are unsuitable.

Thus, for example, during the manufacturing of polyester, a discontinuous or batch-type polymerization can be carried out for process-related reasons. A gear pump can be used for this purpose. During the polymerization phase or circulation phase, very low-viscosity liquid first arrives in the pump causing an extremely low pressure difference in the pump. After the conclusion of the polymerization phase, that is, during the extrusion phase, the pump delivers high-viscosity to medium-viscosity molten mass against pressure consumers connected behind it, such as filters, extrusion tools and the like, causing the pump to have to deliver against a clearly higher pressure difference.

With respect to the pump, the following difficulty will arise:

During the delivery of the highly viscous product, that is, during the extrusion phase, the pressure difference above the pump is sufficiently high for causing a satisfactory lubricating flow or leakage flow through the bearings as well as through the return duct system of the suction side of the pump. After the change-over to the circulation operation, that is, during the pump operation in the polymerization phase, the differential pressure is very low although it is sufficient for the low-viscosity fluid medium. However, at the point in time of the change-over, high-viscosity liquid is still situated in the return system and after the change-over, because of the low differential pressure, can be replaced only very slowly by the new low-viscosity liquid. Because of a stagnation of the bearing leakage current, there is the potential danger of an undersupply of the bearing which may result in the risk of damage to the bearing.

It is therefore an object of the present invention to suggest a return arrangement on a pump shaft which ensures a sufficient leakage lubrication during the delivery of liquids of different viscosities. In particular, it is an object of the invention to ensure the leakage lubrication when a change-over takes place from the delivery of a high-viscosity medium to the delivery of a low-viscosity medium; that is, an extremely impaired flow or even a clogging of the return arrangement for the low-viscosity liquid is prevented.

The above object is achieved by means of a bearing arrangement or a return arrangement for a pump shaft of a pump for the delivery of liquids of very different viscosities having a bearing for the shaft wherein at least one collection or relief zone is arranged on a low-pressure side of the bearing for collecting leakage liquid padding through the bearing along the shaft, and wherein at least two return ducts of bores are provided which connect the collection or relief zone with a suction side of the pump in order to return the collected leakage liquid.

The return duct system suggested according to the invention of a pump for the delivery of liquids of different viscosities (for example, $$\frac{\text{high}}{\text{low}} > 5$$

has at least one collection or relief zone arranged either on each back side of the bearing or on both pump lids, for collecting leakage liquid which penetrates through the bearing along the shaft and which is simultaneously responsible for lubricating the bearing. From the collection or relief zones, the return system has at least two return ducts or bores respectively in order to return the collected leakage liquid to the suction side of the pump.

Preferably, at least one of the ducts or bores can be closed which, depending on the viscosity of the medium to be delivered in the pump, now makes it possible to close one of the bores or to keep all bores or return ducts open. When high-viscosity media are carried, the bore is to be closed for the low-viscosity medium. When the low-viscosity medium or product is delivered, the bore must be open for the low-viscosity medium. In the latter case, the flow resistance ratio is such that the return bore for the high-viscosity product appears closed to the low-viscosity product.

Additional preferred embodiments of the bearing arrangement defined according to the invention or of the return arrangement defined according to the invention are characterized in the by one or more of the following features (i) at least one of the ducts and bores can be selectively closed;

(ii) the ducts or bores are constructed to be selectively closable independently of one another;

(iii) the ducts or bores have different diameters or cross-sections;

(iv) the collection or relief zone is formed by at least one annulus adjoining the shaft; and (v) at least one annulus extends on the back side or low-pressure side at least partially in a slide bearing body or on or in a pump lid, and at least one of the return ducts or bores extends at least partially through or along a slide bearing housing.

In the case of a gear pump, for example, having two return ducts, the return bore which is situated closer to the back side of the bearing or the low-pressure side is reserved for the return of the low-viscosity liquid. Thus, after the change-over from the delivery of a high-viscosity medium to the delivery of the low-viscosity medium, this closer return bore is opened up, which return duct will then not be "clogged" by the high-viscosity medium. Coming back to the abovementioned example of a discontinuous manufacturing of polyester, this closer return duct will be opened up after the change-over to the polymerization and circulation operation. As the result of the polymerization, the viscosity in the polyester to be circulated will rise and, after a certain viscosity has been reached or after a certain differential pressure has been reached or after the change back to the extrusion operation, the closer return duct is closed again so that no high-viscosity material can enter into it. The closing and opening of this closer return bore can take place hydraulically, pneumatically or by means of an electric motor, such as a step motor. Finally, whether the shorter return duct extends through the slide bearing or through the housing surrounding the slide bearing depends, for example, on the geometrical situations. However, both embodiments can be used in any case.

When several slide bearings are used which are arranged side-by-side, it is naturally possible to place return ducts of the same type together at least along a common section; that is, return ducts for low-viscosity media can be placed together as well as return ducts for high-viscosity media.

Other objects, advantages and novel features of the present invention will become apparent from the following detailed description of the invention when considered in conjunction with the accompanying drawings.

DETAILED DESCRIPTION OF THE DRAWINGS

Figure 1:
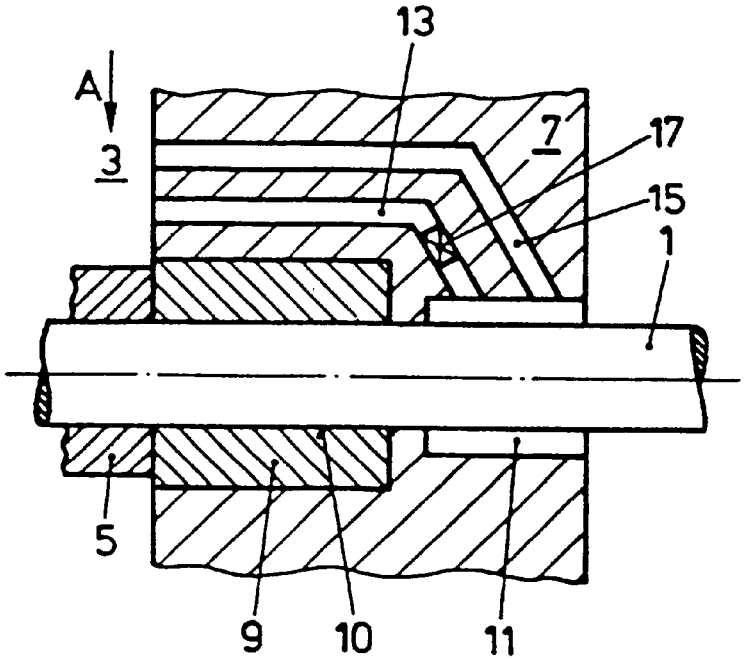
FIG. 1 is a longitudinal sectional view of a housing wall, a slide bearing and a return arrangement constructed according to the invention.

FIG. 1 is a schematic longitudinal sectional view of a bearing of a drive shaft 1 of a gear pump which extends through the housing wall 7. In this case, a gear wheel 5 is arranged on the shaft 1 in the pump space 3 for delivering a viscous liquid in the direction of the arrow A. The shaft 1 is disposed through the housing wall 7 in a slide bearing 9, through which bearing the medium to be delivered is driven along the shaft 1 in the space 10 because of the high pressure in the pump space 3. This so-called leakage liquid is simultaneously used for lubricating the slide bearing 9. On the back side of the slide bearing 9, a collection space or annulus 11 is arranged in order to collect the leakage liquid passing through the slide bearing 9. According to the invention, this collection space or annulus 11 is connected by way of two return ducts 13 and 15 with the suction side of the pump space 3. In order to be able to close the return duct extending closer to the bearing back side, a valve 17, for example, is also provided.

Figure 2:
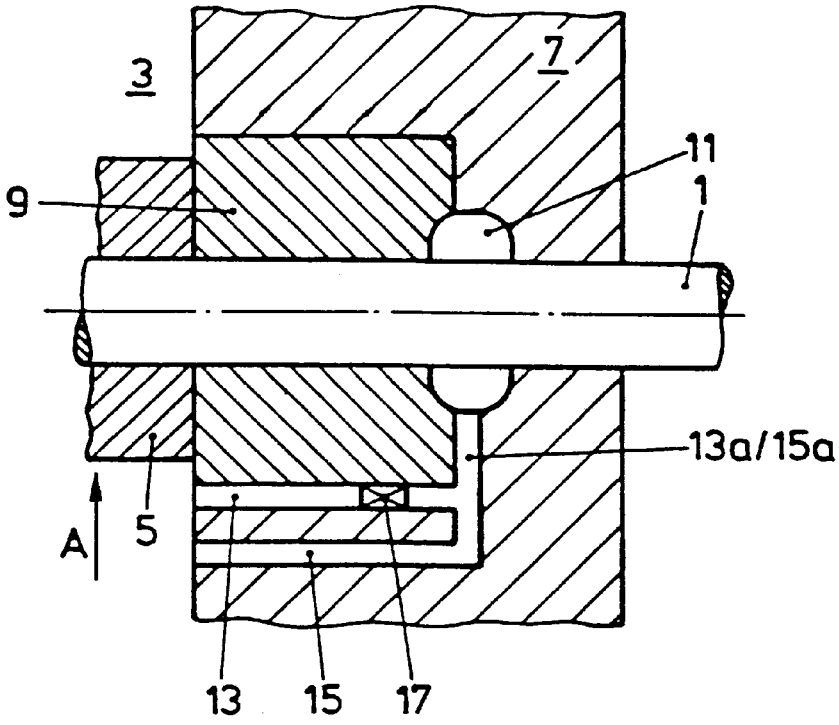
FIGS. 2 and 3 are longitudinal sectional views of additional embodiments of a bearing arrangement according to the invention or of a return arrangement.

Analogously, FIG. 2 is a longitudinal sectional view of another embodiment of a bearing according to the invention or of a return arrangement, in which case only the collection space or annulus 11 is arranged at least partially within the back side of the slide bearing 9. The two return ducts 13 and 15, in turn, are arranged to extend peripherally to the outside from this annulus 11, in which case, because of the representation, at least the branch 13*a* and 15*a* of each return duct which in each case extends perpendicularly to the shaft 1 appears to be situated one upon the other. The two return duct sections 13*a* and 15*a* may also extend independently of one another in this area or may be combined. The reason is that the sections 13*a* and 15*a* may be very short. In contrast, the return bores 13 and 15, which are comparatively long, must extend separately.

Figure 3:
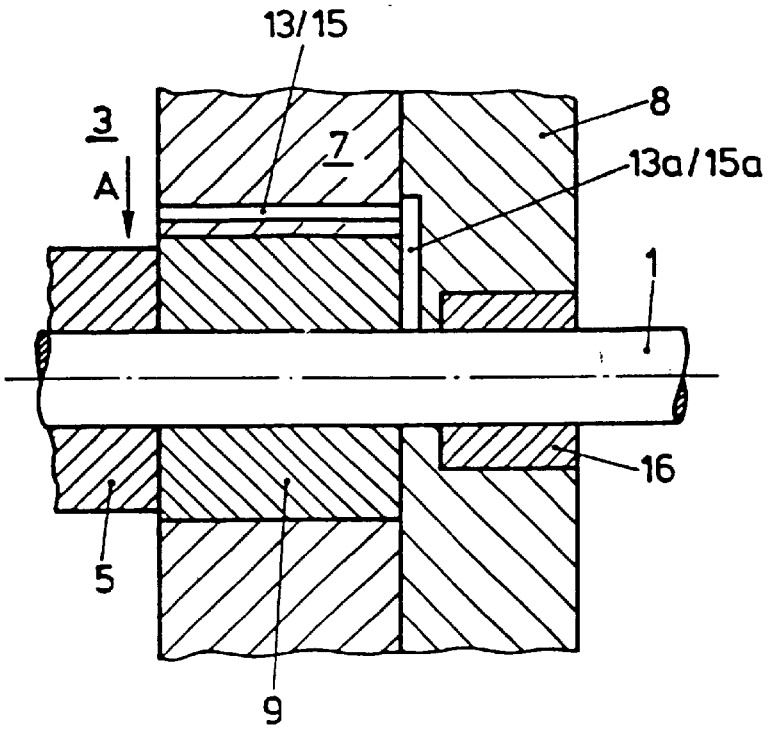

FIG. 3 shows an arrangement similar to that illustrated in FIG. 2 but the return duct sections 13*a* and 15 extend in the lid 8 of the pump. These return duct sections 13*a* and 15*a* may be formed, for example, by a so-called V-groove. This V-groove or these V-grooves lead into the two return bores 13 and 15 which may, for example, be situated behind one another, which is why they do not appear as separately extending bores in the representation according to FIG. 3. Finally, FIG. 3 shows a sealing arrangement 16 in the lid 8.

Figure 4:
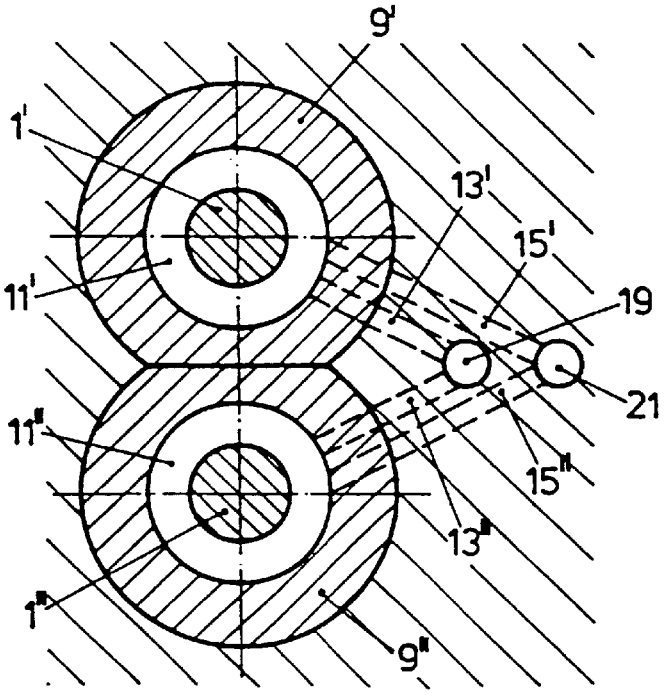
FIG. 4 is a cross-sectional view of two slide bearings of a gear pump arranged side-by-side.

Finally, FIG. 4 shows two slide bearings 9' and 9" arranged side-by-side in the same housing wall 7, the shafts 1' and 1" extending through these slide bearings 9' and 9". On their back side, both bearings have one collection space or annulus 11' and 11" respectively. The ducts 13', 13", 15' and 15" which lead away from this collection ring 11' and 11" each extend in a common return duct 19 and 21 respectively, through which two latter ducts the low-viscosity medium and the high-viscosity medium are in each case returned into the pump on the suction side.

The return arrangements according to the invention illustrated in FIGS. 1 to 4 are naturally only examples which can be changed, modified or supplemented in any manner. Thus, it is naturally possible to arrange additional return ducts, and, in the case of several return ducts, to construct more than one return duct to be closable. This may be useful, for example, if the viscosities of the various liquids to be delivered deviate significantly from one another. The closability of the return ducts may also be achieved in different fashions but this is know-how existing per se which does not have to be explained here in detail. It is also not important whether the return ducts partly extend through the bearings themselves or through the housing wall. Finally, it should be pointed out that the sealing arrangement which in the following adjoins the collection space or annulus was not shown in the figures because it is not part of the present invention.

Finally, it should be pointed out that the arrangement according to the invention was explained by means of a gear pump but that naturally the arrangement according to the invention can be used wherever leakage liquids must be carried away and returned.

It is also significant with respect to the invention that the removal and return system has at least two return ducts or bores for each side of the pump.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Bearing arrangement for a pump shaft for delivering newtonian or non-newtonian liquids of different viscosities, having a bearing for the shaft, wherein at least one collection or relief zone is arranged on a low-pressure side of the bearing for collecting leakage liquid passing through the bearing along the shaft, and wherein at least two return ducts or bores are provided which connect the collection or relief zone with a suction side of the pump in order to return the collected leakage liquid, and said return ducts or bores extend in parallel to a space for the passage of the leakage liquid along the shaft.

2. Bearing, according to claim 1, wherein at least one of the ducts and bores can be selectively closed.

3. Bearing according to claim 1, wherein the ducts or bores are constructed to be selectively closable independently of one another.

4. Bearing according to claim 1, wherein the ducts or bores have different diameters or cross-sections.

5. Bearing according to claim 1, wherein the collection or relief zone is formed by at least one annulus adjoining the shaft.

6. Bearing according to claim 1, wherein at least one annulus extends on the back side or low-pressure side at least partially in a slide bearing body or on or in a pump lid, and at least one of the return ducts or bores extends at least partially through or along a slide bearing housing.

7. Bearing according to claim 3, wherein the ducts or bores have different diameters or cross-sections.

8. Bearing according to claim 3, wherein the collection or relief zone is formed by at least one annulus adjoining the shaft.

9. Bearing according to claim 3, wherein at least one annulus extends on the back side or low-pressure side at least partially in a slide bearing body or on or in a pump lid, and at least one of the return ducts or bores extends at least partially through or along a slide bearing housing.

10. Gear pump comprising:

a housing wall, a pump shaft supported in the housing wall by a bearing, and a gear supported on the pump shaft and operable to pump newtonian and non-newtonian liquids of different viscosities, wherein at least one collection or relief zone is arranged on a low-pressure side of the bearing for collecting leakage liquid passing through the bearing along the shaft, and wherein at least two return ducts or bores are provided which connect the collection or relief zone with a suction side of the pump in order to return the collected leakage liquid, and said return ducts or bores extend in parallel to a space for the passage of the leakage along the shaft.

11. Gear pump according to claim 10, wherein at least one of the ducts and bores can be selectively closed.

12. Gear pump according to claim 10, wherein the ducts or bores are constructed to be selectively closable independently of one another.

13. Gear pump according to claim 12, wherein the ducts or bores have different diameters or cross-sections.

14. Gear pump according to claim 10, wherein a pair of pump shafts are supported at respective bearings disposed parallel to one another in said housing wall.

15. Gear pump according to claim 14, wherein two identical return ducts or bores respectively of the two bearings respectively extend side-by-side in the pump housing wall and are at least partially combined or have one joint section respectively.

16. Process for collecting leakage liquid passing through a pump slide bearing having a collection zone and at least two return ducts connecting the collection zone with a suction side of the pump, and for returning the leakage liquid in pumps for liquids having different viscosities, comprising:

collecting leakage liquid of a certain viscosity passing through the bearing along the shaft on the bearing low pressure side in a collection or relief zone and, by way of at least one of the return ducts, returning the same to the suction side of the pump, while at least one of the additional return ducts remains closed when a certain differential pressure is reached or exceeded in the pump.

17. Process according to claim 16, wherein during the delivery of high-viscosity media, at least one of the return ducts remains closed, and, during the delivery of low-viscosity media, that is, when there is a falling-below a predetermined differential pressure in the pump, at least one of the additional closed return ducts is opened up in order to ensure the return of the low-viscosity medium from the collection zone into the suction-side area of the pump.

18. Process according to claim 16, wherein low-viscosity media is returned through the return duct situated closer to the bearing low-pressure side, whereby such duct is preferably constructed to be closable.

* * * * *